US005553665A

United States Patent [19]

Gentry

[11] Patent Number: 5,553,665

[45] Date of Patent: Sep. 10, 1996

[54] ROD BAFFLE HEAT EXCHANGERS UTILIZING DUAL SUPPORT STRIP

[75] Inventor: Cecil C. Gentry, Bartlesville, Okla.

[73] Assignee: Phillips Petroleum Company, Bartlesville, Okla.

[21] Appl. No.: 370,921

[22] Filed: Jan. 10, 1995

[51] Int. Cl.[6] ..... F28F 9/013

[52] U.S. Cl. ..... 165/162; 165/69; 122/510

[58] Field of Search ..... 165/69, 159, 162; 122/510

[56] References Cited

U.S. PATENT DOCUMENTS

| | | | |
|---|---|---|---|
| 3,637,008 | 1/1972 | Michel et al. | 165/69 |
| 4,127,165 | 11/1978 | Small | 165/162 |
| 4,398,595 | 8/1983 | Small | 165/109 R |
| 4,433,721 | 2/1984 | Biaggi | 165/162 |
| 4,538,756 | 9/1985 | Trenkler et al. | 228/118 |
| 4,635,707 | 1/1987 | Gentry | 165/1 |
| 4,640,342 | 2/1987 | Appleman | 165/69 |
| 4,720,840 | 1/1988 | Lagally et al. | 165/69 X |
| 4,860,697 | 8/1989 | Malaval | 122/510 |
| 4,917,172 | 4/1990 | Falduti | 165/69 X |
| 5,002,123 | 3/1991 | Nelson et al. | 165/147 |
| 5,058,664 | 10/1991 | Gentry | 165/162 |
| 5,139,084 | 8/1992 | Gentry | 165/162 |
| 5,255,737 | 10/1993 | Gentry et al. | 165/159 |

FOREIGN PATENT DOCUMENTS

| | | | |
|---|---|---|---|
| 1017455 | 1/1966 | United Kingdom | 165/162 |

*Primary Examiner*—Leonard R. Leo
*Attorney, Agent, or Firm*—Ryan N. Cross

[57] ABSTRACT

A rod baffle heat exchanger utilizing an improved rod baffle is disclosed. The improved rod baffle has a baffle ring and support member comprised of a first strip and a second strip each attached to the ring and extending across said ring such that each strip will support an adjacent tube row. Struts are attached to and extend between the first and second strip. The improved rod baffle provides for a reduced longitudinal-flow, shell-side pressure drop over a solid support member.

7 Claims, 4 Drawing Sheets

ROD BAFFLE HEAT EXCHANGERS UTILIZING DUAL SUPPORT STRIP

The present invention relates generally to heat exchangers, and more particularly, but not by way of limitation, to rod baffle heat exchangers.

Rod baffle heat exchangers are shell and tube type heat exchangers utilizing rod baffles to support the tubes and secure them against vibrations. Additionally, rod baffles can be used to correct shell-side flow maldistributions and to create a more turbulent shell-side flow. The term "baffle" refers to an annular ring in which the ends of a plurality of support rods are connected; hence the term "rod baffle".

In certain applications, such as surface condensers and power plant applications, it is critical to minimize longitudinal-flow, shell-side pressure losses within a rod baffle heat exchanger. Reduction in shell-side pressure losses may be accomplished by increasing rod baffle spacing, thereby reducing the number of rod baffles, or by decreasing the number of tubes by increasing the tube pitch dimension, i.e., the distance between two adjacent rows of tubes as measured from the center of the tubes. Increasing baffle spacing is usually not a viable option, since increased baffle spacing increases the likelihood of flow-induced tube vibration occurrence. Decreasing the tube count by increasing tube pitch dimension produces decreased shell-side pressure loss for longitudinal-flow between rod baffles, but requires oversized support rod diameters, which in conventional rod baffle designs must be equal to tube pitch minus tube outer diameter. This increase in support rod diameter produces increased rod baffle pressure loss contributions, which may offset any decrease in longitudinal-flow, shell-side pressure loss attributed to reduce tube count. It, therefore, would be advantageous to reduce the longitudinal-flow, shell-side pressure loss in a rod baffle heat exchanger without significantly increasing the rod baffle pressure loss contribution and without increasing the likelihood of flow induced tube vibration occurrence.

SUMMARY OF THE INVENTION

It is one object of this invention to provide a rod baffle heat exchanger having a reduced shell-side pressure loss compared to prior rod baffle heat exchangers and, yet, avoiding any increase in the likelihood of flow-induced tube vibration occurrence.

It is another object of this invention to increase the tube pitch dimension of a rod baffle heat exchanger without a significant increase in the longitudinal-flow, shell-side pressure loss contributions of the support rods.

In accordance with this invention, there is provided a rod baffle heat exchanger comprising a plurality of parallel tubes with a common axis of alignment arranged to form a plurality of tube rows with lanes between adjacent tube rows; a ring surrounding the plurality of tubes; and a plurality of support members, which replace conventional rods in a rod baffle exchanger, positioned in at least a portion of the lanes, with each support member having a first strip, a second strip and a plurality of support struts, wherein the first strip has a first end and a second end which are fixedly secured to the ring so that the strip extends along a first chord of the ting with the first chord lying in one of the lanes between the adjacent tube rows such that the first strip is in contact with substantially all the tubes in the first row of the adjacent tube rows forming the lane, wherein the second strip has a first end and a second end which are fixedly secured to the ring so that the second strip extends along a second chord of the ring with the second chord lying in the lane between the adjacent tube rows such that the second strip is in contact with substantially all the tubes in the second row of the adjacent tube rows forming the lane, and wherein the support struts are spaced along the first strip and the second strip such that each support strut extends from the first strip to the second strip and has a first end fixedly secured to the first strip and a second end fixedly secured to the second strip.

DETAILED DESCRIPTION OF THE INVENTION

Figure 1:
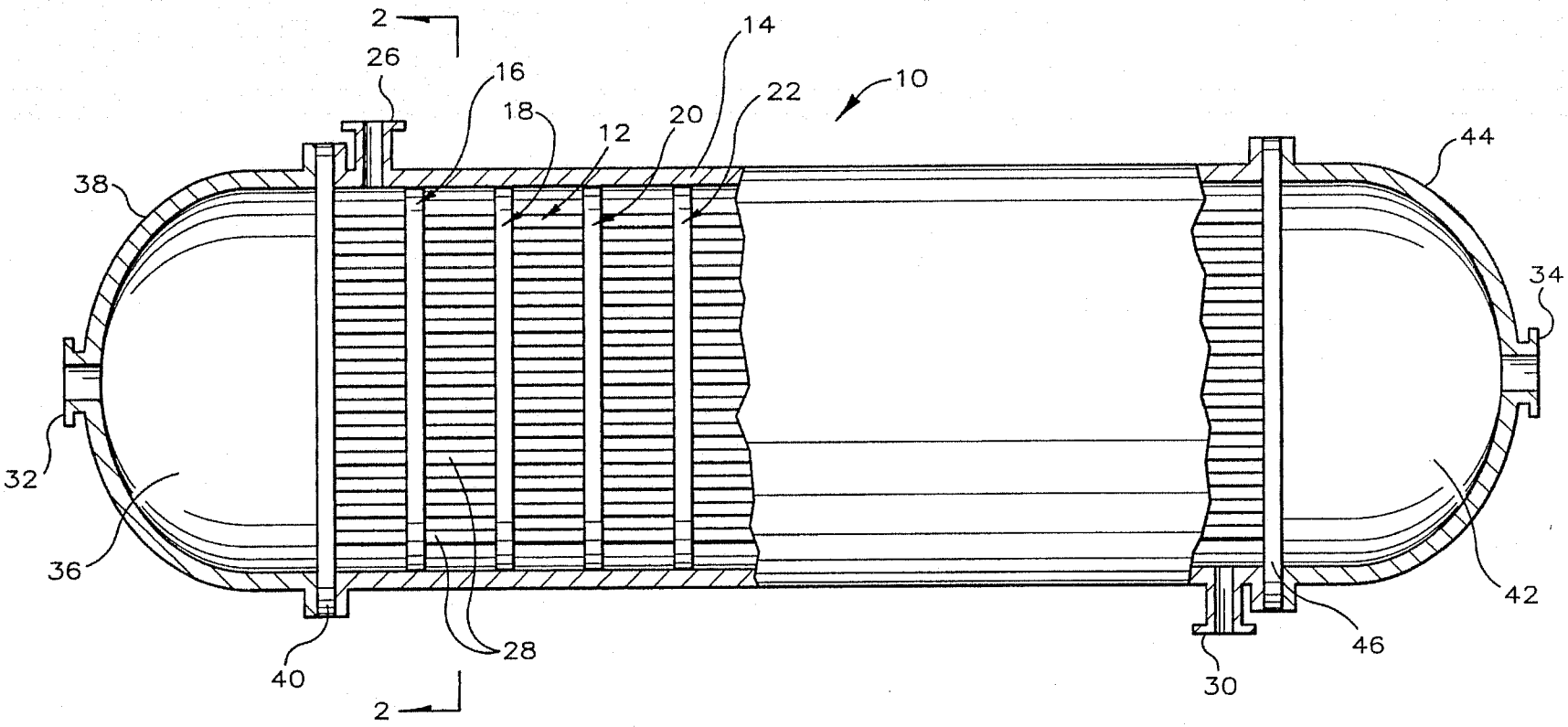
FIG. 1 is a side elevation view of a shell and tube type heat exchanger constructed in accordance with the invention with portions of the shell broken away to more clearly illustrate the internal structure.

Referring now to the drawings, and to FIG. 1 in particular, there is illustrated a shell and tube heat exchanger 10 wherein a rod baffle bundle 12 is surrounded by shell 14. The tubes 28 in the tube bundle 12 are supported by a plurality of rod baffle assemblies 16, 18, 20 and 22. One fluid enters the shell-side of the shell and tube heat exchanger 10 through inlet 26 and after heat exchange with the fluid in the tubes 28 leaves the shell-side via outlet 30. The fluid flowing through the tube side of the heat exchanger enters the endcap 38 of the heat exchanger via inlet 32 and leaves the endcap 44 of a heat exchanger via outlet 34. This fluid flows from end chamber 36 which is defined by endcap 38 of the heat exchanger and the tube sheet 40 through the tubes 28 and into the opposite end chamber 42 which is similarly defined by the endcap 44 and the other tube sheet 46.

Figure 2:
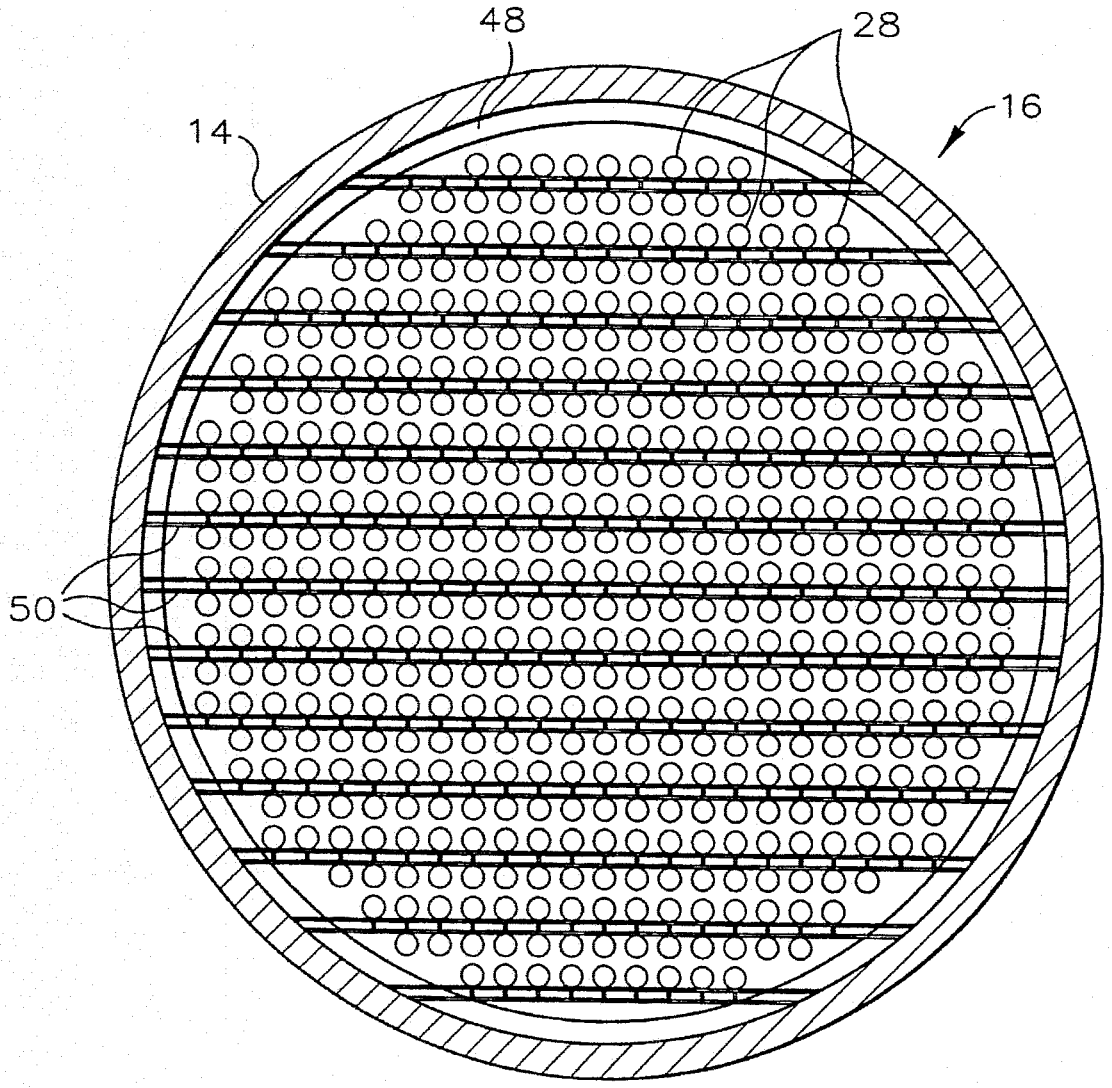
FIG. 2 is an enlarged cross-sectional view taken along line 2—2 of FIG. 1.
Figure 3A:
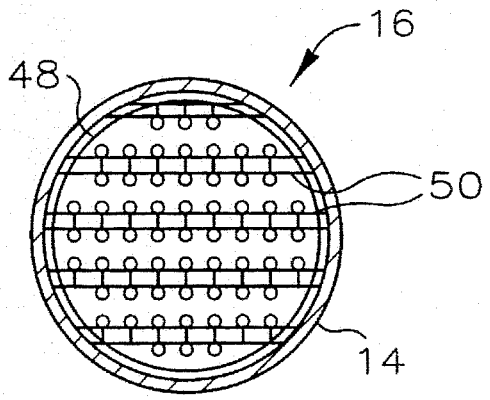
FIGS. 3A–3D represent elevation views of a four baffle set according to the invention.
Figure 3C:
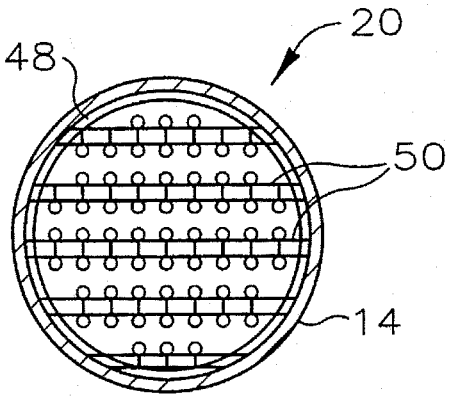
Figure 3B:
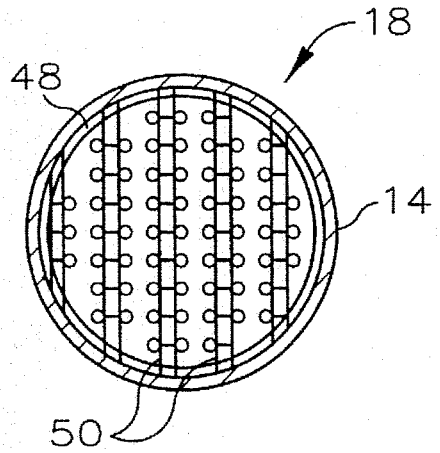
Figure 3D:
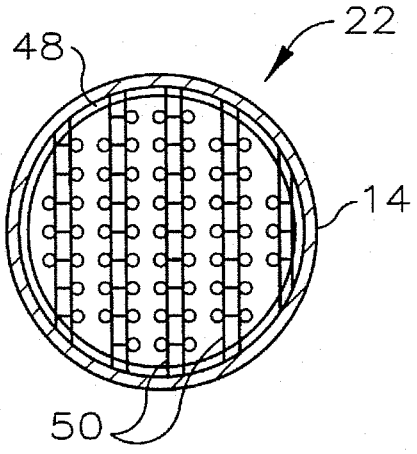

The tubes 28 can be arranged in a square pattern as shown in FIG. 2. The tubes 28 are kept in position by a plurality of rod baffle assemblies 16, 18, 20 and 22. These rod baffle assemblies, an example of which is shown in FIG. 2, each comprise a baffle ring 48 and a plurality of baffle support members 50, in the form of dual support strips, that are fixedly secured at their opposite ends to the baffle ring 48 and are evenly spaced so that they extend between pairs of the parallel rows of tubes 28.

Typically, the baffle support members 50 will extend horizontally, as shown in FIG. 2, or else they will extend vertically. Generally, the shell and tube heat exchanger will have a series of rod baffle assemblies with at least a portion of the rod baffle assemblies having horizontally extending baffle support members and at least a portion of the rod baffle assemblies having vertically extending baffle support members. Preferably, the tube and shell heat exchanger 10 will have at least one four baffle set comprising two vertical rod baffle assemblies and two horizontal rod baffle assemblies with the baffle support members 50 spaced so that they extend between alternate pairs of vertical or horizontal, parallel rows of tubes 28. Furthermore, the pair of horizontal rod baffle assemblies should have the baffle support members 50 positioned such that the tube rows between which the baffle support members 50 extend are not the same tube rows for both horizontal rod baffle assemblies. Similarly, the baffle support members 50 of the vertical rod baffle assemblies would have the baffle support members 50 positioned such that the tube rows between which the baffle support members 50 extend are not the same tube rows for both vertical rod baffle assemblies. Such a four baffle set allows for adequate tube support while minimizing shell-side pressure loss contributions of the support rods. A four baffle set is illustrated in FIGS. 3A–3D.

FIGS. 3A–3D show first rod baffle assembly 16, second rod baffle assembly 18, third rod baffle assembly 20, and fourth rod baffle assembly 22, respectively. Rod baffle assembly 16 and 20 contain horizontal baffle support members 50 while rod baffle assemblies 18 and 22 contain vertical baffle support members 50. It will be noted, however, that the rows of tubes 28 between which the support members 50 of rod baffle assembly 20 extend are not the rows of tubes 28 between which the support members 50 of rod baffle assembly 16 extend. The baffle support members of rod baffle assembly 20 are positioned between horizontal tube rows which are opened or unbaffled in the rod baffle assembly 16. It will, also, be noted that the tube rows between which the support members 50 of the rod baffle assembly 22 extend are not the tube rows between which the support members 50 of rod baffle assembly 18 extend. The support members of rod baffle assembly 22 are positioned between vertical tube rows which are opened or unbaffled in the baffle assembly 18. Thus, the four baffles together provide radial support on all four sides of each tube 28.

The four baffle set of rod baffle assemblies is further described in U.S. Pat. No. 5,139,084 and U.S. Pat. No. 4,398,595, both of which are hereby incorporated by reference.

Additionally, cross-support members (not shown) can be provided to add further support to tubes 28. Cross-support members would be similar to support members 50 in design but extend across the baffle ring to which they are attached perpendicular to the support members 50 also attached thereto.

Figure 4:
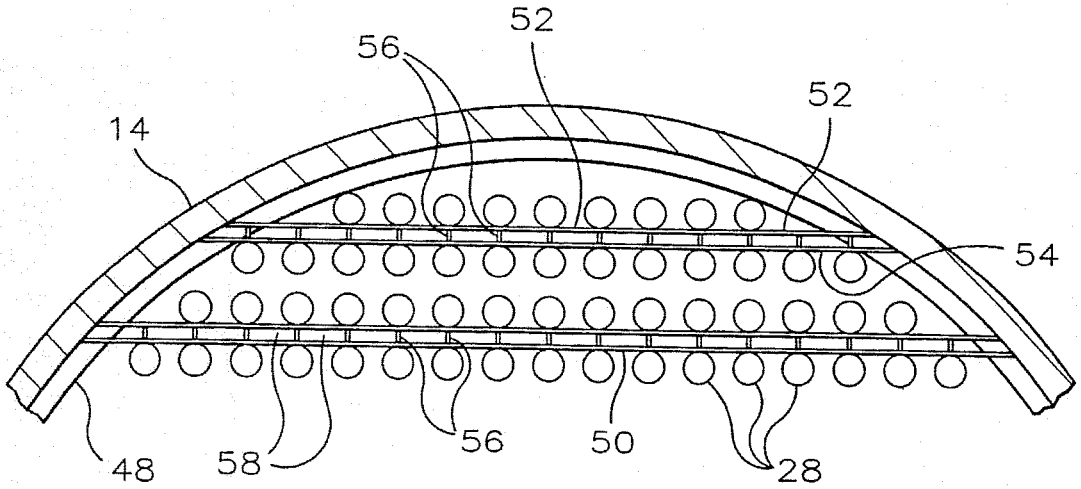
FIG. 4 is an enlarged partial cross-sectional view more clearly illustrating the upper portion of the rod baffle illustrated in the embodiment of FIG. 2.
Figure 5:
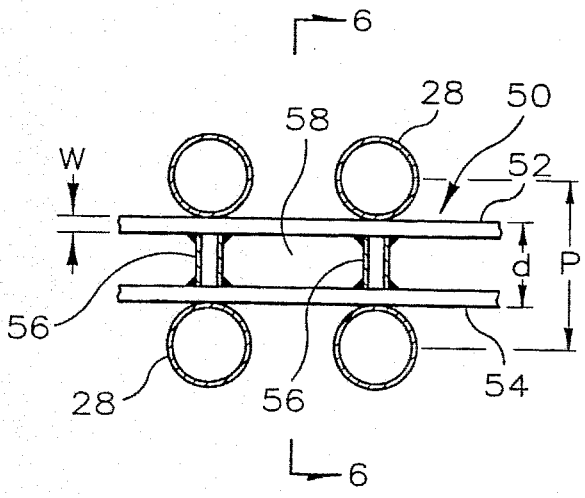
FIG. 5 is an enlarged partial view of the support member utilized in FIG. 4, more clearly illustrating the support member of the invention.
Figure 6:
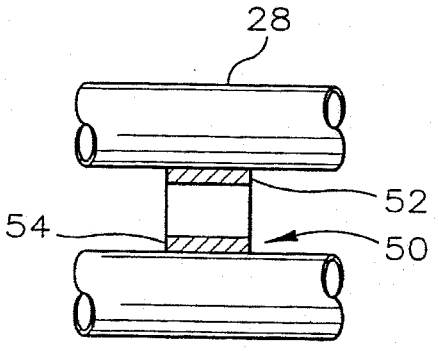
FIG. 6 is a cross-sectional view taken along line 6—6 of FIG. 5.

Turning now to FIGS. 4, 5 and 6, the baffle support member 50 illustrated in FIGS. 2 and 3 can be better seen. The baffle support member 50 is in the form of dual support strips and is comprised of a first rod or strip 52, a second rod or strip 54 and a plurality of support struts 56. First strip 52, second strip 54 and a pair of support struts 56 together define a passage 58 through which shell side fluid can flow.

The ends of first strip 52 are attached by a suitable method, such as welding, to baffle ring 48. Similarly, the ends of second strip 54 are attached to baffle ring 48. Each pair of strips, first strip 52 and first strip 54, are positioned such that first strip 52 extends along a first chord of the ring with the chord lying in the lane between two adjacent tube rows such that the first strip 52 is in contact with substantially all the tubes in one of the tube rows and the second strip 54 lies along a chord in the same lane but in contact with substantially all the tubes in the other tube row forming the lane. Thus, first strip 52 comes in contact with and supports the tubes of one of the tube rows while second strip 54 comes in contact with and supports the tubes of the other tube row. Support struts 56 are spaced along the first and second strip such that each support strut extends from the first strip to the second strip and has a first end fixedly secured to the first strip 52 and a second strip fixedly secured to the second strip 54. The struts 56 can be attached to each strip by any suitable manner, such as welding. The struts 56 help provide structural integrity to the baffle support members by giving the baffle support members greater rigidity than the first strip or second strip would have alone. The structural support provided by the struts 56 will be greatest at the strut location and, therefore, it is preferable that the struts be located at each tube location so that they provide maximum support against tube vibrations.

The thickness w of the first and second strip should be chosen in order to assure adequate support of tubes 28 and to maximize the passages 58 formed by the first strip 52, the second strip 54 and struts 56. By maximizing the passages 58 the maximum flow of shell-side fluid will be obtained and, thus, the longitudinal shell-side pressure loss will be minimized. While thickness w of the individual support rods may vary, in order to maximize structural support and minimize shell-side pressure loss the thickness should be from about 10 percent to about 40 percent of the spacing d between adjacent tube rows, preferably the thickness will be from about 20 percent to about 30 percent of the spacing d between adjacent tube rows and most preferably about 25 percent of the spacing d between adjacent tube rows. The spacing d can be found by subtracting the tube outer diameter from the tube pitch p. Thus, by maximizing the gaps 58 while still assuring adequate support of the tubes 28, a support member according to the invention will cause less of a longitudinal-flow, shell-side pressure drop than a solid rod or support member and still secure the tubes against vibrations.

To assemble the heat exchanger 10, the tubes 28 are inserted through the baffle assemblies 16, 18, 20, 22 etc. which are spaced apart as illustrated in FIG. 1. At this point the tubes 28 are supported by the baffle support members 50 of the baffle assemblies 16, 18, 20 and 22. The ends of the tubes 28 are then received through the corresponding apertures formed in the tube sheets 40 and 46. When suitably positioned, the tubes 28 are fixedly secured to the tube sheets 40 and 46 with each end of each tube forming a fluid fight seal with the corresponding aperture in each tube sheet.

Alternatively, the first end of each tube 28 can be fixedly secured to the tube sheet 40 before insertion of the tubes 28 through the baffle assemblies with each first end of each tube 28 forming a fluid tight seal with the corresponding aperture in the tube sheet 40. After insertion of the tubes 28 through the baffle assemblies, the second ends of each tube 28 are fixedly secured to the tube sheet 46 with the second end of each tube 28 forming a fluid tight seal with the corresponding aperture in the tube sheet 46.

The tube bundle 12, thus assembled, is inserted into the open end of the shell 14 and properly positioned therein at which time the open ends of the shell 14 are closed by suitable endcaps 38 and 44.

Reasonable variations and modifications which will be apparent to those skilled in the art can be made in this invention without parting from the spirit and scope thereof.

That which is claimed:

1. An apparatus comprising:

a plurality of parallel tubes with a common axis of alignment arranged to form a plurality of tube rows lanes between adjacent tube rows;

a ring surrounding said plurality of tubes; and a plurality of support members positioned in at least a portion of said lanes, with each support member having a first strip, a second strip and a plurality of support struts, wherein said first strip has a first end and a second end which are fixedly secured to said ring so that said first strip extends along a first chord of said ring with said first chord lying in one of said lanes between said adjacent tube rows such that said first strip is in contact with substantially all said tubes in the first row of said adjacent tube rows forming said lane, wherein said second strip has a first end and a second which are fixedly secured to said ring so that said second strip extends along a second chord of said ring with said second chord lying in said lane between said adjacent tube rows such that said second strip is in contact with substantially all said tubes in the second row of said row of said adjacent tube rows forming said lane, and wherein said support struts are spaced along said first strip and said second strip such that each support strut extends from the first strip to the second strip and has a first end fixedly secured to said first and second end fixedly secured to said second strip and such that said support struts are located at each tube location.

2. An apparatus according to claim 1 wherein said ring lies in a plane substantially normal to said common axis of alignment of said plurality of tubes.

3. An apparatus according to claim 1 further comprising a least four of said tings each having a plurality of said support members fixedly secured thereto such that said rings and said support members together form a four baffle set so that each tube is provided radial support on four sides.

4. An apparatus according to claim 1 wherein said first strip and said second strip each have a thickness from about 10% to about 40% of the spacing between adjacent tube rows.

5. An apparatus according to claim 1 wherein said first strip and said second strip each have a thickness from about 20% to about 30% of the spacing between adjacent tube rows.

6. An apparatus according to claim 1 wherein said first strip and said second strip each have a thickness of about 25% of the spacing between adjacent tube rows.

7. An apparatus comprising:

a plurality of parallel tubes with a common axis of alignment arranged to form a plurality of tube rows with lanes between adjacent tube rows;

a plurality of rings surrounding said plurality of tubes in a plane about normal to said common axis of alignment;

a plurality of support members positioned between adjacent tube rows with each support member having a first strip having a thickness of about 25% of the spacing between adjacent tube rows, a second strip having a thickness of about 25% of the spacing between adjacent tube rows and a plurality of support struts, wherein said first strip has a first end and a second end which are fixedly secured to one of said rings so that said first strip extends along a first chord of said ring said first chord lying in one of the lanes between said adjacent tube rows such that said first strip is in contact with substantially all said tubes in the first row of said adjacent tube rows forming said lane, wherein said second strip has a first end and a second end which are fixedly secured to said ring so that said second strip extends along a second chord of said ring with said second chord lying in said lane between said adjacent tube rows such that said second strip is in contact with substantially all said tubes in the second row of said adjacent tube rows forming said lane, wherein said support struts are spaced along said first strip and said second strip at each tube location and each support strut has a first end and a second end wherein said first end is fixedly secured to said first strip and said second end is fixedly secured to said second strip, and wherein said rings and said support members together form a four baffle set so that each tube is provided radial support on four sides.

* * * * *